US007111902B1

(12) United States Patent
Conner

(10) Patent No.: US 7,111,902 B1
(45) Date of Patent: Sep. 26, 2006

(54) FOLDING CHAIR WITH GANGING ELEMENTS

(75) Inventor: John P Conner, Grandville, MI (US)

(73) Assignee: Irwin Seating Company, Grand Rapids, MI (US)

( * ) Notice: Subject to any disclaimer, the term of this patent is extended or adjusted under 35 U.S.C. 154(b) by 0 days.

(21) Appl. No.: 11/140,693

(22) Filed: May 31, 2005

Related U.S. Application Data

(60) Provisional application No. 60/582,677, filed on Jun. 24, 2004.

(51) Int. Cl.
*A47C 15/00* (2006.01)

(52) U.S. Cl. ..... 297/248

(58) Field of Classification Search ..... 297/248, 297/234, 249, 232; 248/200
See application file for complete search history.

(56) References Cited

U.S. PATENT DOCUMENTS 1,198,726 A * 9/1916 Huntley ..... 297/248
1,740,806 A 12/1929 Clarin
1,900,486 A 3/1933 Clarin
2,664,943 A 1/1954 Clarin
2,982,339 A 5/1961 Clarin
2,996,331 A 8/1961 Clarin
3,001,816 A 9/1961 Clarin
3,111,344 A 11/1963 Hoven et al.
3,402,963 A 9/1968 Fujioka et al.
3,695,694 A 10/1972 Mohr
3,827,749 A * 8/1974 Johnson et al. ..... 297/248
3,847,433 A 11/1974 Acton et al.
4,154,476 A * 5/1979 Blodee ..... 297/248
4,305,617 A 12/1981 Benoit
4,386,804 A * 6/1983 Ware et al. ..... 297/248
4,400,031 A 8/1983 DeDecker
D274,771 S 7/1984 Ambasz et al.
4,655,504 A 4/1987 Weber
4,684,172 A 8/1987 Lundquist
4,685,732 A 8/1987 Kapp et al.
4,978,168 A 12/1990 Piretti
5,002,337 A * 3/1991 Engel et al. ..... 297/239
D333,733 S 3/1993 Sammons
5,282,669 A 2/1994 Barile
5,586,806 A 12/1996 Hergott
5,957,530 A * 9/1999 Gutgsell ..... 297/248
6,089,651 A 7/2000 Carmen
6,092,866 A 7/2000 Wu
6,099,073 A 8/2000 Bruschi
6,106,061 A 8/2000 Caruso et al.
6,193,307 B1 2/2001 Lin (Continued)

*Primary Examiner*—Milton Nelson, Jr.
(74) *Attorney, Agent, or Firm*—Van Dyke, Gardner, Linn & Burkhart, LLP

(57) ABSTRACT

A plurality of chairs are configured to be ganged together such that the chairs are releasably held together in a side-by-side manner. The chairs include a first chair having a first leg at a side of the first chair, and a second chair having a second leg at a side of the second chair. The first and second legs are generally opposed when the first and second chairs are side-by-side and facing in generally the same direction. The first chair includes a lower ganging element attached at a lower end of the first leg and configured to receive a lower end of the second leg when the second chair is positioned next to the first chair. The first chair includes an upper ganging element attached along a portion of the first leg and configured to receive a corresponding portion of the second leg.

20 Claims, 6 Drawing Sheets

U.S. PATENT DOCUMENTS

D443,995 S 6/2001 Caruso et al.
6,305,742 B1 10/2001 Spendlove et al.
6,406,094 B1 * 6/2002 Lohness et al. ..... 297/248
6,422,645 B1 7/2002 Smith et al.
6,478,375 B1 11/2002 Richardson
6,585,314 B1 7/2003 Richardson

* cited by examiner

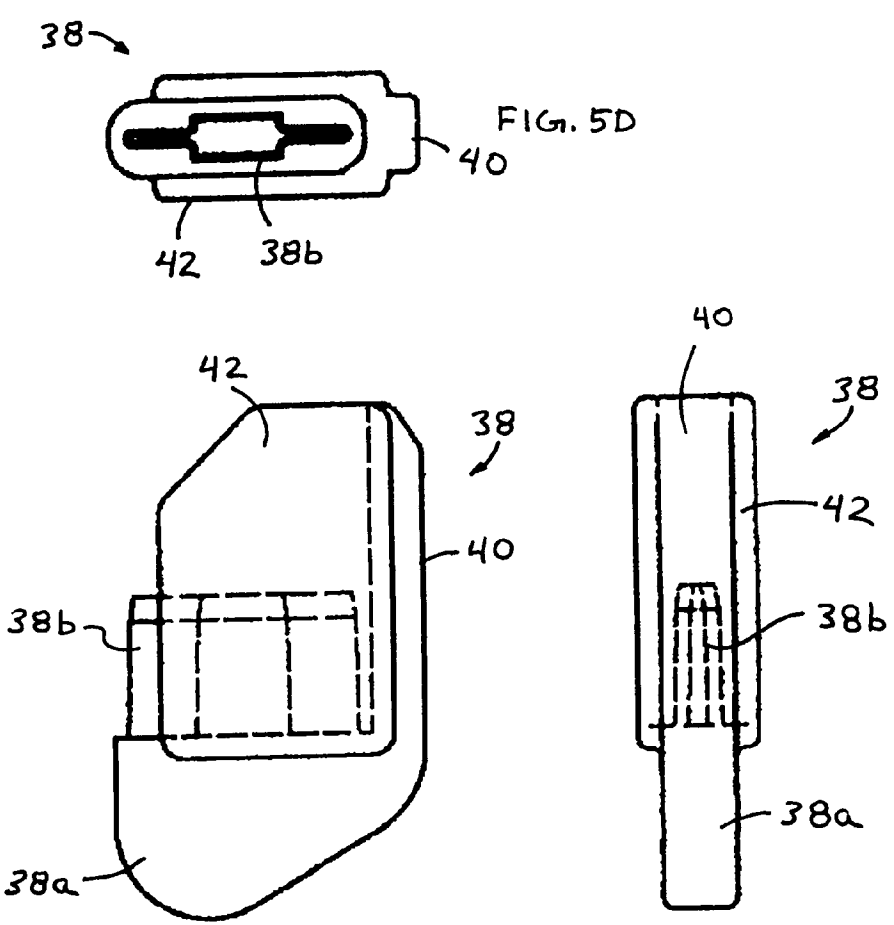
FIG. 5C
FIG. 5B
FIG. 5D
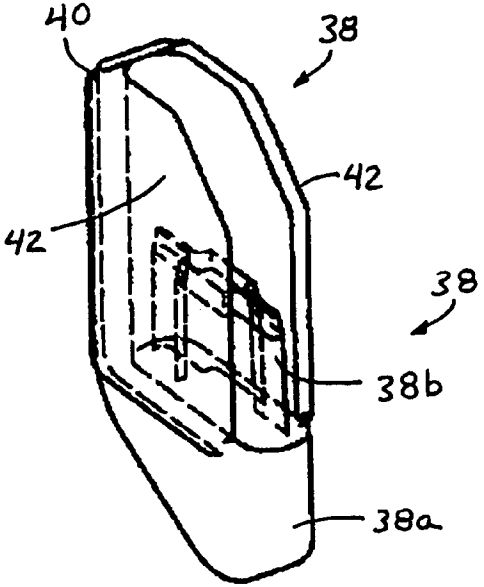
FIG. 5A

FOLDING CHAIR WITH GANGING ELEMENTS

CROSS REFERENCE TO RELATED APPLICATION

The present application claims benefit of U.S. provisional application Ser. No. 60/582,677, filed Jun. 24, 2004, which is hereby incorporated herein by reference in its entirety.

FIELD OF THE INVENTION

The present invention relates to chairs and, more particularly, to chairs, such as folding chairs, that may be ganged or joined together to form a row of chairs.

BACKGROUND OF THE INVENTION

It is known in the art to provide a ganging element or elements to gang or interlock or substantially retain two or more chairs together in a row. Such ganging elements often include a pin or tab on one chair that inserts into a corresponding slot or bracket on another chair to retain the chairs together. While such an arrangement may hold the chairs together, it is often difficult to assemble or gang the chairs together and to disassemble or separate the chairs when desired. Also, the process of joining and separating of the chairs often causes damage to the pin or the slot.

Therefore, there is a need in the art for gangable chairs, such as gangable folding chairs, that overcome the shortcomings of the prior art.

SUMMARY OF THE INVENTION

The present invention provides a ganging or connecting arrangement or assembly that is configured to releasably retain one chair in side-by-side relationship with another chair so as to form a row of connected chairs. The ganging element or elements of one chair may readily receive a leg of another chair to retain the chairs together and may readily release the leg of the other chair to disassemble or separate the chairs. The ganging elements limit or substantially preclude generally lateral and vertical movement of one chair relative to the other while the chairs are connected or ganged together. The ganging elements are configured so that the chairs may be readily connected or separated by pivoting the front leg of one chair relative to the front leg of the other chair without having to align a small pin with a slot and sliding or lifting one chair relative to the other chair.

According to an aspect of the present invention, a pair of chairs, such as folding chairs or the like, is configured to be ganged together such that the chairs are releasably held together in a side-by-side manner. The chairs include a first chair having a first leg (such as a front leg) at a side of the first chair, and a second chair having a second leg (such as a front leg) at a side of the second chair. The first and second legs are generally opposed when the first and second chairs are side-by-side and facing in generally the same direction. The first chair includes a lower ganging element or member attached at a lower end of the first leg and configured to receive a lower end of the second leg when the second chair is positioned next to the first chair. An upper ganging element or member is attached along a portion of the first or second leg and is configured to receive a corresponding portion of the other leg. The second chair is substantially secured to the first chair via the upper and lower ganging elements or members such that the second leg is substantially limited in moving laterally and vertically relative to the first leg.

The lower ganging element may comprise a collar attached to the lower end of the first leg and defining a passageway therethrough for receiving the lower end of the second leg at least partially therethrough. The lower end of the second leg may include a stop member that is configured to limit retraction of the second leg from the passageway. The stop member may be configured to limit retraction of the stop member and second leg from the passageway when the first and second legs are generally parallel to one another. The stop member may be configured to be retractable from the passageway when the second leg is angled forwardly relative to the first leg. The stop member may include a tab extending generally rearwardly to engage the lower ganging element to limit retraction of the stop member when the first and second legs are generally parallel to one another.

The upper ganging element at the first or second leg may define a channel for receiving the corresponding portion of the other leg therealong when the first and second legs are generally parallel to and adjacent to or juxtaposed to one another. In one form, the upper ganging element is positioned at the first leg and is configured to receive the second leg. The second leg thus may be insertable partially through the lower ganging element at an angle relative to the first leg, and then may be pivotable relative to the first leg when so inserted to move the corresponding portion of the second leg into the upper ganging element along the first leg to substantially secure the chairs together. In another form, the upper ganging element may be positioned at the second leg and may be configured to receive the first leg therein as the second leg is pivoted toward alignment with the first leg.

According to another aspect of the present invention, a method of ganging at least two chairs together includes providing at least two chairs. One of the chairs has a first leg and another of the chairs has a second leg. A lower ganging element is provided at a lower end of the first leg, and an upper ganging element is provided partially along the first or second leg. A lower end of second leg of one chair is inserted at least partially through the lower ganging element of the other chair. The second leg of the one chair is pivoted generally about the lower ganging element and toward alignment with the first leg of the other chair. The upper ganging element of the first or second leg receives a portion of the other leg to substantially retain the chairs together.

Therefore, the present invention provides a ganging arrangement or configuration that releasably secures two or more chairs together in a row. The ganging arrangement limits or substantially precludes lateral and vertical movement of one chair relative to another to substantially retain the chairs in place along the row. The chairs may be connected or ganged together by inserting a leg of one chair into a lower ganging element and pivoting the chair rearward and toward the ground so as to engage an upper ganging element. The chairs thus may be readily connected and retained together along a row. The chairs may also be readily disconnected by pivoting the chair forwardly and then lifting the chair to retract the leg of the one chair from the lower ganging element of the other chair. The ganging arrangement of the present invention thus provides for easy ganging of the chairs, while providing a robust arrangement that is not readily damaged or bent during assembly and disassembly of a row of chairs.

These and other objects, advantages, purposes and features of the present invention will become apparent upon review of the following specification in conjunction with the drawings.

BRIEF DESCRIPTION OF THE DRAWINGS

FIGS. 5A–5D are views of a stop member and foot for the other of the front legs of the chairs of FIG. 1;

DESCRIPTION OF THE PREFERRED EMBODIMENTS

Figure 1:
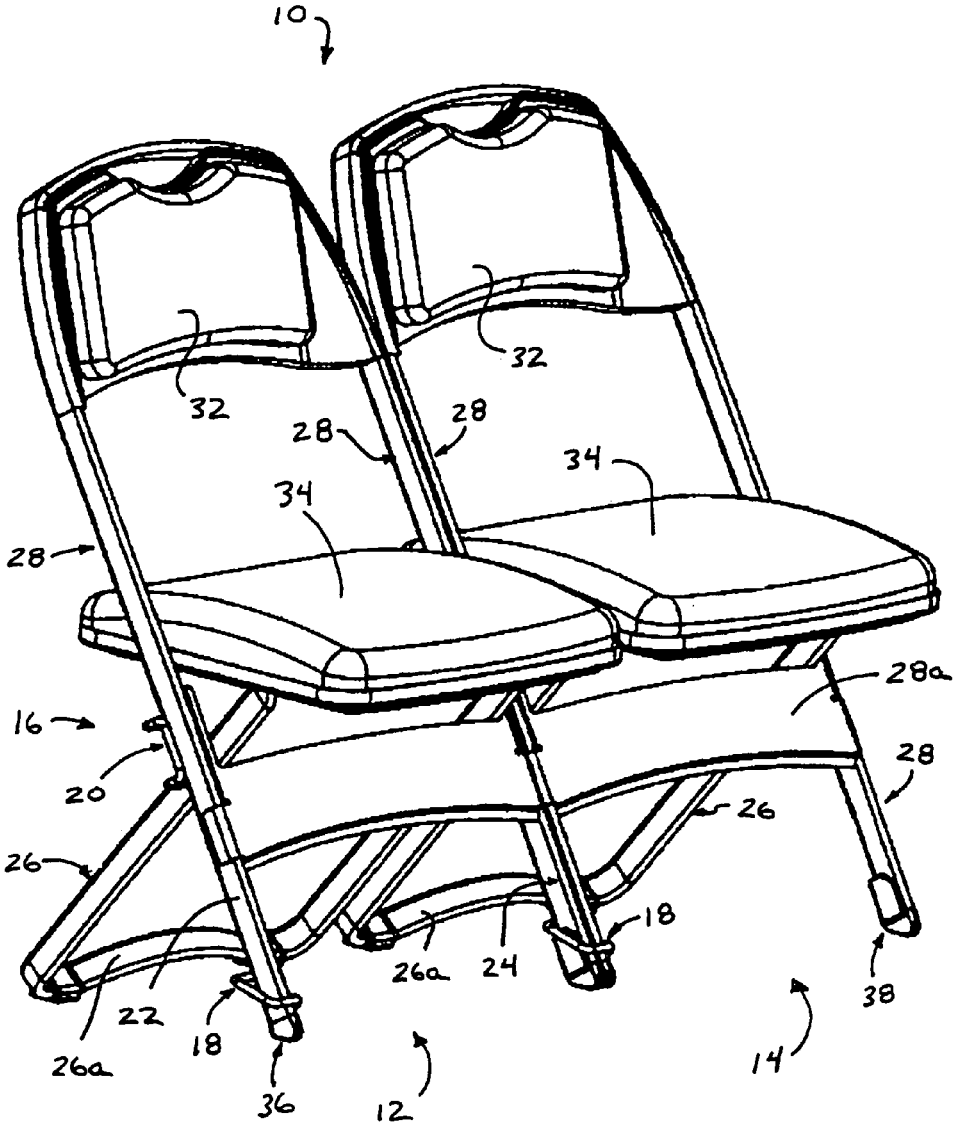
FIG. 1 is a perspective view of a pair of chairs ganged together in accordance with the present invention.
Figure 2:
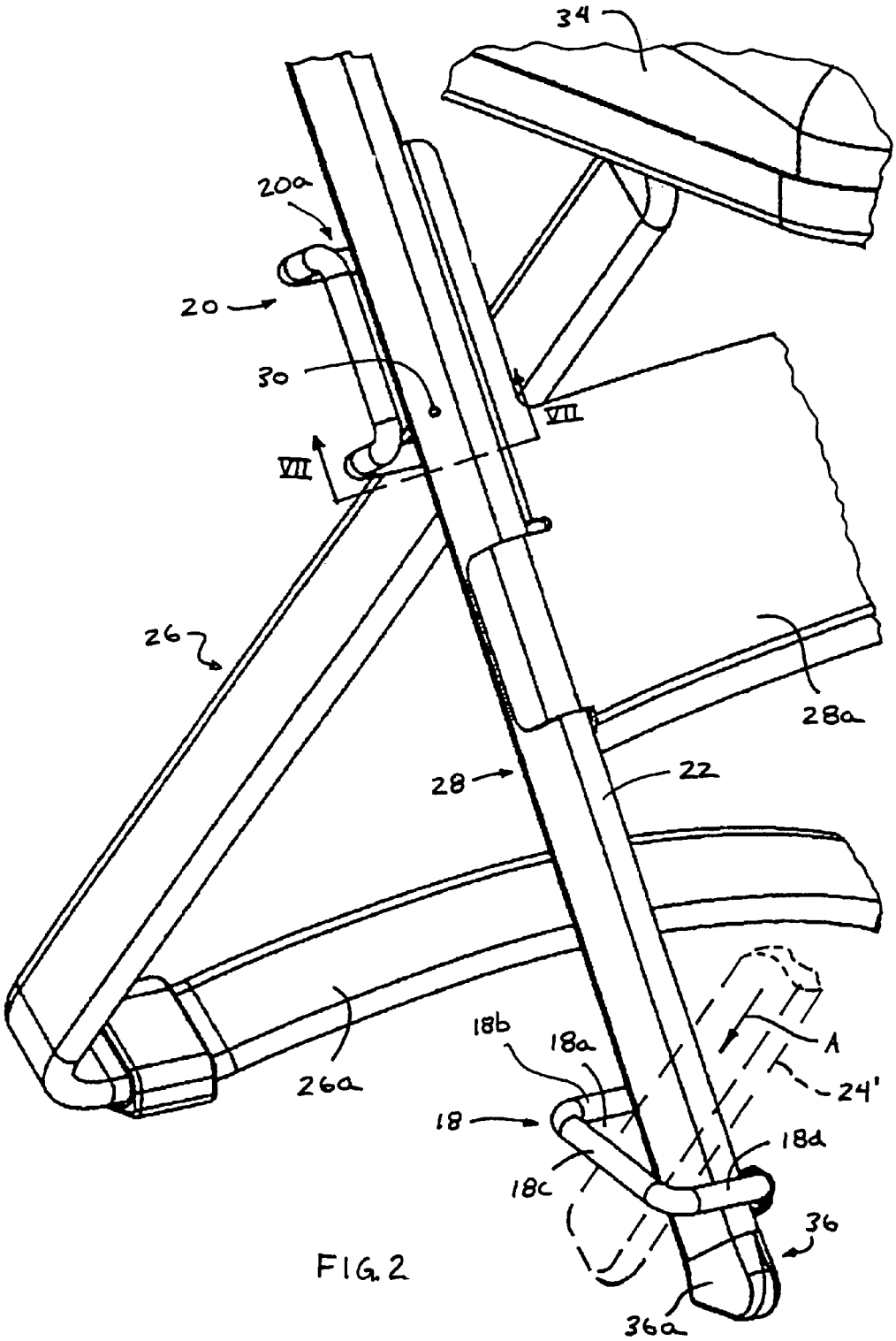
FIG. 2 is a an enlarged perspective view of the legs of one side of one of a chair of FIG. 1.
Figure 3:
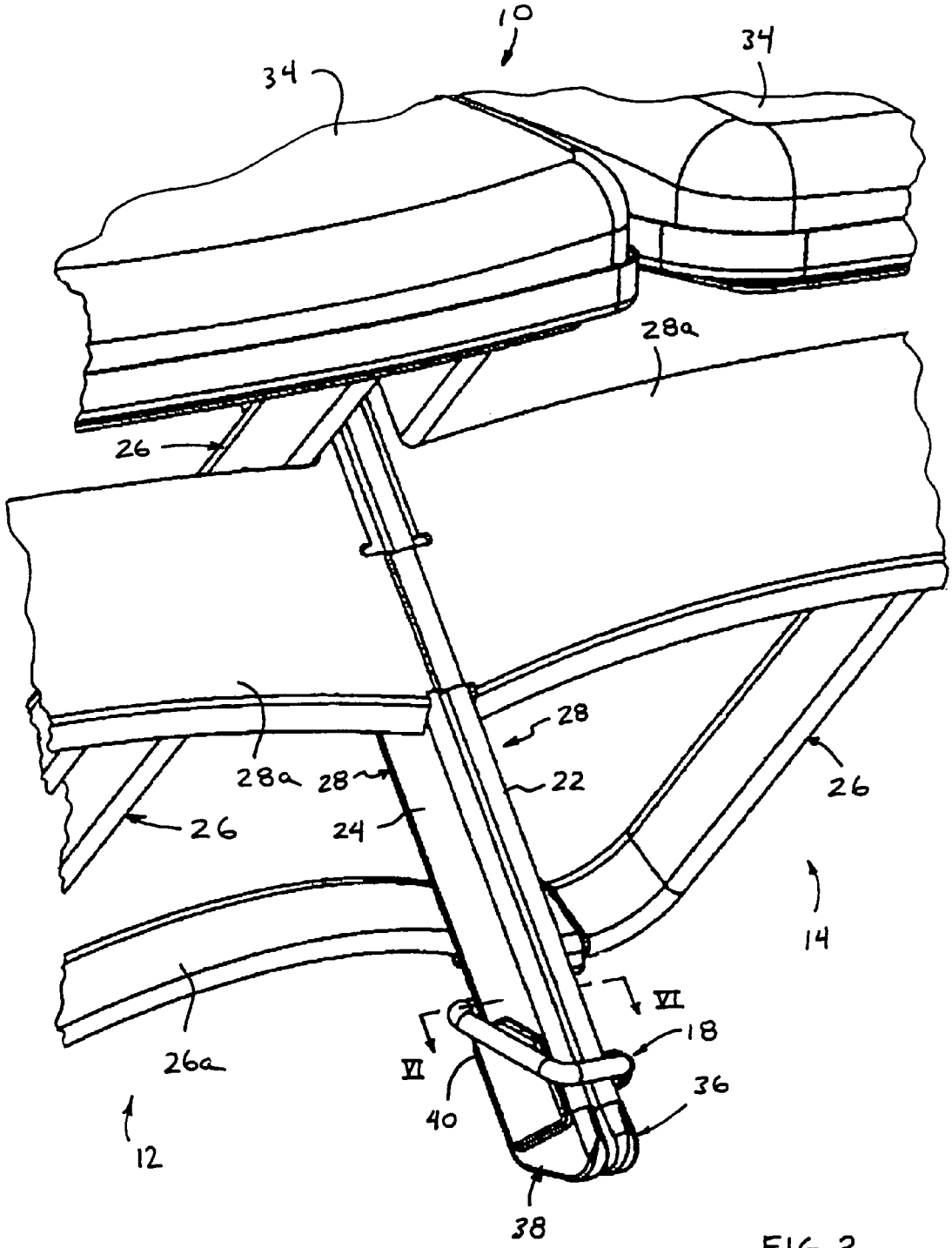
FIG. 3 is an enlarged perspective view of the joined legs of the chairs of FIG. 1, showing the legs ganged together by a lower ganging element of the present invention.
Figure 4A:
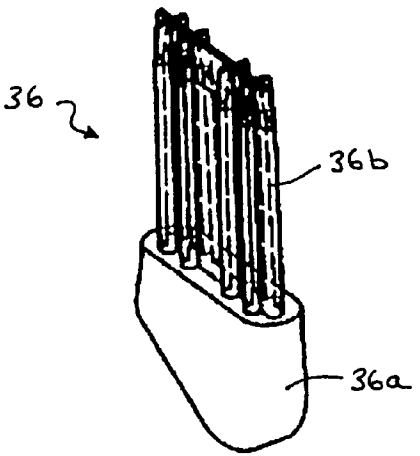
FIGS. 4A–4D are views of a foot or attachment for one of the front legs of the chairs of FIG. 1.
Figure 4B:
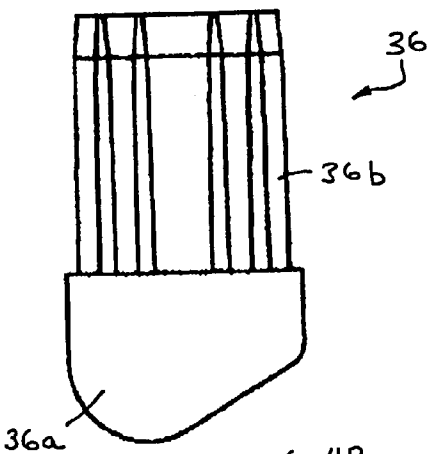
Figure 4C:
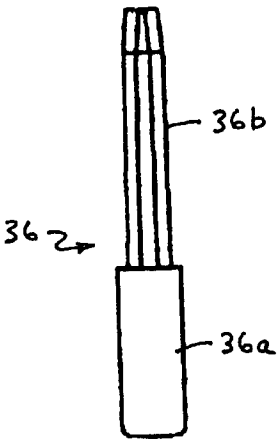
Figure 4D:
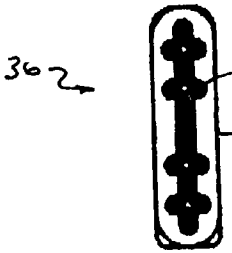

Referring now to the drawings and the illustrative embodiments depicted therein, a seating arrangement 10 includes a plurality of chairs (such as the two chairs 12, 14 in the illustrations) that are releasably ganged or connected or joined or secured together via a ganging or securing assembly or configuration 16 (FIGS. 1–3). Ganging assembly 16 includes a lower ganging element 18 and an upper ganging element 20 along a leg 22 of one or both of the chairs. The ganging elements 18, 20 are configured to receive and retain another leg 24 of the other chair 14 to substantially secure the chairs 12, 14 relative to one another, as discussed below. When so secured, the chairs may be connected in side-by-side relationship with each chair facing generally the same direction, as shown in FIG. 1.

Chairs 12, 14 may comprise any type of chair, such as folding chairs or the like which are foldable between a storage position, where each chair may be folded generally flat, and an in-use position, where each chair is unfolded for use as shown in the illustrations. In the illustrated embodiment, chairs 12, 14 are folding chairs that each have a pair of rear legs 26 pivotally attached to a pair of front legs 28, such that the legs 26, 28 are pivotable relative to one another about a pivot pin or axis 30 (FIG. 2) to fold and unfold the chair. As shown in FIG. 1, rear legs 26 may be connected together via a cross member 26*a*, while front legs 28 may also be connected together via a cross member 28*a*, and may support a seat back or rest 32 at the upper ends of the front legs. A seat cushion 34 is pivotally attached to the legs, such as in a manner as known in the field of folding chairs.

Figure 6:
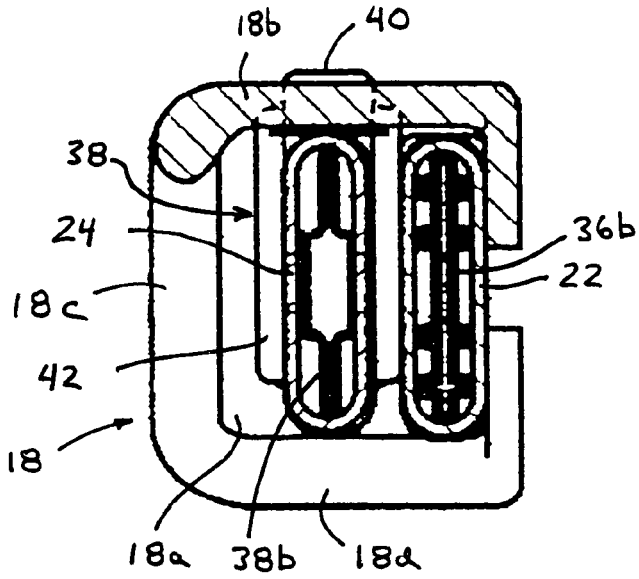
FIG. 6 is a sectional view of the ganged legs and lower ganging element taken along the line VI—VI in FIG. 3.

Lower ganging element 18 is positioned at a lower end of leg 22, which may be one of the front legs 28, such as the right front leg of the chairs in the illustrated embodiment. Lower ganging element 18 may comprise a collar or ring that is attached to the leg 22 and that defines an opening or passageway 18*a* (FIG. 2) therethrough for receiving the end of leg 24 (such as the left front leg of the chairs in the illustrated embodiment) therethrough, as discussed below. Lower ganging element 18 may be formed of a metal (or other suitable material) rod, such as 5/16 inch rod or the like, that is bent or formed into a ring shape or rectangular shape, and that is welded or otherwise secured to leg 22 of the chair. However, other types of materials and sizes may be implemented for the lower ganging element, without affecting the scope of the present invention. The ganging element 18 thus may have a rear leg 18*b* extending laterally along a rear end of legs 22, 24 and a side leg 18*c* connecting rear leg 18*b* to a front leg 18*d*, as best shown in FIGS. 2 and 6. The ends of the lower ganging element may be welded or otherwise secured or attached to leg 22. As can be seen in FIGS. 1–3, lower ganging element 18 may be mounted or secured to leg 22 at an angle, such that lower ganging element 18 may be generally parallel to the support surface when the chair is set up in its upright and in-use position. This orientation of lower ganging element 18 provides a larger passageway for insertion in a direction generally normal to a plane defined by and through each leg 18*b*–*d* of lower ganging element 18 (such as the direction A in FIG. 2), while providing a narrowed passageway for insertion or retraction in the generally vertical direction, as discussed below.

Figure 7:
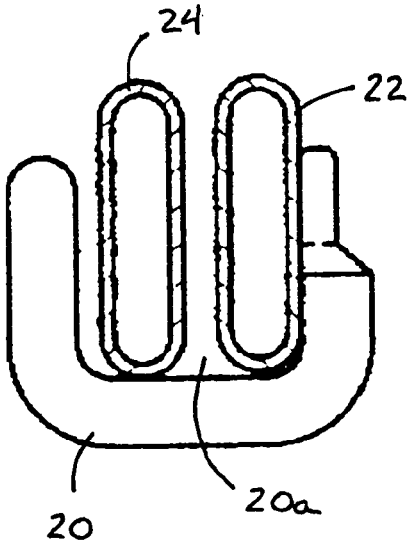
FIG. 7 is a sectional view of the upper ganging element taken along the line VII—VII in FIG. 2, showing how a second chair leg is received within the upper ganging element.

In the illustrated embodiment, upper ganging element 20 is positioned along leg 22 and above and spaced from lower ganging element 18, as shown in FIGS. 1 and 2. Upper ganging element 20 may define a generally U-shaped channel 20*a* for receiving leg 24 of the other chair therealong (as best shown in FIG. 7), as discussed below. As shown in FIG. 2, the channel is opened or faces generally upwardly and forwardly to receive the other leg 24 as the leg 24 is pivoted generally downwardly and rearwardly about lower ganging element 18, as discussed below. Upper ganging element 20 may be formed of a metal (or other suitable material) rod, such as a 5/16 inch rod or the like, that is bent or formed into the desired shape, and that is welded or otherwise secured to leg 22 of the chair. However, other types of materials and sizes may be implemented for the upper ganging element, without affecting the scope of the present invention.

Accordingly, when it is desired to gang or connect or join a row of chairs together, a first chair 12 may be unfolded and set in place at the desired area for the row to begin. The second chair 14 may also be unfolded, and the lower end of the left front leg 24 of chair 14 may be inserted into and through lower ganging element 18 (at the lower end of the right front leg 22 of chair 12). Preferably, the front leg 24 is inserted at least partially through the lower ganging element 18 while the chair 14 and front leg 24 are tilted forwardly (such as in the direction A and generally along the tilted leg 24' in FIG. 2), so that the rear legs 26 are raised from the ground. When the lower end of leg 24 is so inserted, chair 14 may be pivoted rearwardly and downwardly generally about the lower ganging element 18 so that the rear legs 26 move toward the ground. As the chair 14 is pivoted in this manner, the front leg 24 is received along the U-shaped channel 20*a* of upper ganging element 20 (as shown in FIG. 7) to secure the chairs 12, 14 together in a row. Additional chairs (not shown) may be unfolded and arranged next to chair 14 in a similar manner as described above. As can readily be seen in the illustrations, the upper and lower ganging elements limit or substantially preclude lateral movement of one chair relative to another, while the lower ganging element limits generally vertical movement of the legs relative to one another, such that the chairs are substantially secured and retained together along the row.

Optionally, the lower ends of the front legs (and/or rear legs) may include or receive a foot, such as a rubber foot or the like. In the illustrated embodiment, the lower end of the leg 22 (that has the lower ganging element 18 attached thereto) may have a foot 36, such as the foot 36 shown in FIGS. 4A–D. Foot 36 includes a base portion 36*a* and a stem or insertion portion 36*b* that inserts within the hollow end of leg 22 to attach foot 36 to leg 22, such as in a manner as is known in the art. Likewise, the lower end of leg 24 (that inserts into the lower ganging element 18 to gang or connect the chairs together) may receive or have a foot 38, such as the foot 38 shown in FIGS. 5A–D. Foot 38 also includes a base portion 38*a* and a stem or insertion portion 38*b* that inserts within the hollow end of leg 24 to attach foot 38 to leg 24. The feet 36, 38, which may comprise a rubber or elastomeric material or other suitable material, provide support for the chair and provide protection of the legs and of the ground or floor upon which the chairs are placed, and may reduce or limit sliding of the chairs along the floor or support surface.

Optionally, and preferably, foot 38 of leg 24 includes a stop member or stop portion or element 40 at and partially along a rear side or end of the foot 38. As can be seen in FIGS. 5A–D, foot 38 may include an outer sleeve portion 42 that receives leg 24 therein (and generally between stem 38*b* and sleeve 42) and that includes stop element 40 at a rearward portion thereof, such that stop element 40 is formed or positioned along the rear side of the lower end of the leg 24 and extends rearwardly therefrom when foot 38 is attached to leg 24. As can be best seen in FIGS. 3 and 6, stop element 40 extends rearward from leg 24 and is positioned generally beneath rear leg 18*b* of lower ganging element 18 when leg 24 and foot 38 are inserted through lower ganging element 18 and when chair 14 is in its upright and in-use position next to chair 12. Stop element 40 thus functions to engage lower ganging element 18 and to thus limit or substantially preclude lifting of leg 24 and foot 38 out from lower ganging element 18 in a generally vertical direction. As can be seen in FIG. 6 (which is a view taken along the legs 22, 24), stop element 40 will engage lower ganging element 18 to limit or substantially preclude retraction of leg 24 from lower ganging element 18 when leg 24 is moved in a direction generally along the legs 22, 24 or generally vertically.

Therefore, in order to insert foot 38 and lower end of leg 24 into or at least partially through lower ganging element 18, leg 24 is angled forwardly (such as shown in phantom at 24' in FIG. 2). In this orientation, foot 38 and stop element 40 may be generally aligned with the passageway 18*a* of lower ganging element 18 and thus may readily fit through and insert through the lower ganging element. When so inserted, leg 24 (and chair 14) may be tilted or pivoted rearwardly to move or pivot stop element 40 into position beneath lower ganging element 18 and to move leg 24 into upper ganging element 20. This process may be repeated along a row of chairs in an orderly and efficient manner. When connected or retained in this manner, the ganging elements or members limit or substantially preclude relative lateral movement and relative generally vertical movement between the chairs so that the chairs are substantially retained or secured together in a row.

Likewise, in order to separate the chairs 12, 14 from one another, chair 14 is first tilted or pivoted forwardly (generally about lower ganging element 18) to lift leg 24 out of upper ganging element 20. When tilted in this manner, foot 38 and stop element 40 may be generally aligned with the passageway 18*a* through lower ganging element 18, so that the leg 24 and foot 38 and stop element 40 may be readily removed from the ganging element (such as by moving leg 24 in a direction generally normal to the plane of the lower ganging element or in a direction generally opposite to the direction A in FIG. 2) to separate the chairs. The chairs thus may be readily separated without having to slide locking pins along slots or the like. This process may be repeated along a row of chairs to separate and fold and store the chairs when the chairs are not in use or when it is desired to separate the chairs for individual use. The ganging assembly or arrangement of the present invention thus provides an enhanced means for securing and separating a row of chairs.

Although shown as having the ganging elements on the right front legs of the chairs, clearly the ganging elements may be located elsewhere on the chairs, such as on the left front leg, without affecting the scope of the present invention. It is further envisioned that the ganging elements may be positioned at and along a front or rear leg of other types of chairs so that the chairs may be arranged and connected in a similar manner as described above, without affecting the scope of the present invention. For example, the ganging elements of the present invention may be suitable for use in non-folding type chairs or the like, and/or may be implemented at and along the rear leg or legs of such chairs.

Also, it is envisioned that one leg of a chair may include the lower ganging element, while the opposed leg of the other chair may include the upper ganging element, without affecting the scope of the present invention. For example, the upper ganging element may be attached to the left front leg or second (the leg of the second chair that is inserted into the lower ganging element of the first chair) so that the upper ganging element engages and receives a portion of the right front leg or first leg (the leg with the lower ganging element attached thereto) as the second chair is pivoted rearward and downward relative to the first chair. In such an application, the upper ganging element may be substantially reversed or flipped as compared to the upper ganging element of the illustrated embodiment, such that the channel of the upper ganging element may open generally rearwardly and downwardly to receive the other leg as the chair and upper ganging element are pivoted or moved rearwardly and downwardly toward and into alignment with the first chair. Optionally, it is further envisioned that each leg may have an upper ganging element at different heights along the leg, so that both upper ganging elements receive a corresponding portion of the other leg as the chairs are pivoted or moved into alignment, without affecting the scope of the present invention.

Therefore, the present invention provides a ganging arrangement or configuration or assembly or system that readily joins or secures two or more chairs together in a row. The ganging arrangement limits lateral and vertical movement of one chair relative to another to substantially retain the chairs in place along the row. The chairs may be connected or ganged together by inserting a leg of one chair into a lower ganging element and pivoting the chair rearward and toward the ground so as to engage an upper ganging element. The chairs thus may be readily connected and retained together along a row. The chairs may also be readily disconnected by pivoting the chair forwardly and then lifting the chair. The ganging arrangement of the present invention thus provides for easy ganging of the chairs, while providing a robust arrangement that is not readily damaged or bent during assembly and disassembly of a row of chairs.

Changes and modifications to the specifically described embodiments may be carried out without departing from the principles of the present invention, which is intended to be limited only by the scope of the appended claims as interpreted according to the principles of patent law.

The embodiments of the invention in which an exclusive property or privilege is claimed are defined as follows:

1. A pair of chairs configured to be ganged together such that said chairs are releasably held together in a side-by-side manner, said chairs comprising:

a first chair having a first leg at a side of said first chair;

a second chair having a second leg at a side of said second chair, said first and second legs being generally opposed when said first and second chairs are side-by-side and facing in generally the same direction;

a lower ganging element attached at a lower end of said first leg and protruding laterally outwardly therefrom, said lower ganging element being configured to receive a lower end of said second leg at least partially therein when said second leg of said second chair is positioned next to said first leg of said first chair; and an upper ganging element attached along a portion of one of said first leg and said second leg, said upper ganging element being configured to receive a corresponding portion of the other of said first leg and said second leg, said second chair being substantially secured to said first chair via said upper and lower ganging elements such that said second leg is substantially limited in moving laterally and vertically relative to said first leg.

2. The chairs of claim 1, wherein said chairs comprise folding chairs that have front and rear legs that are pivotable relative to one another to fold and unfold the chairs.

3. The chairs of claim 1, wherein said lower ganging element comprises a collar attached to said lower end of said first leg and defining a passageway therethrough for at least partially receiving said lower end of said second leg.

4. The chairs of claim 3, wherein said lower end of said second leg includes a stop member that is configured to limit retraction of said second leg from said passageway.

5. The chairs of claim 4, wherein said stop member is configured to limit retraction of said stop member from said passageway when said first and second legs are generally parallel to one another.

6. The chairs of claim 5, wherein said stop member is configured to be retractable from said passageway when said second leg is angled forwardly relative to said first leg.

7. The chairs of claim 4, wherein said stop member includes a tab extending generally rearward to engage said lower ganging element to limit retraction of said stop member when said first and second legs are generally parallel to one another.

8. The chairs of claim 1, wherein said upper ganging element defines a channel for receiving said corresponding portion of said other of said first leg and said second leg therealong when said first and second legs are generally parallel to and juxtaposed with one another.

9. The chairs of claim 8, wherein said second leg is insertable partially through said lower ganging element at an angle relative to said first leg, said second leg being pivotable relative to said first leg when so inserted to move said corresponding portion of said other of said first leg and said second leg into said upper ganging element to substantially secure said chairs together.

10. The chairs of claim 1, wherein said upper ganging element is attached along said first leg and spaced from said lower ganging element for receiving a corresponding portion of said second leg.

11. A method of ganging at least two chairs together, said method comprising;

providing at least two chairs, one of said chairs having a first leg and another of said chairs having a second leg;

providing a lower ganging element at a lower end of said first leg and providing an upper ganging element partially along one of said first leg and said second leg;

inserting a lower end of said second leg at least partially through said lower ganging element, pivoting said second leg generally about said lower ganging element and toward alignment with said first leg; and receiving the other of said first leg and said second leg at least partially within said upper ganging element at said one of said first leg and said second leg to substantially retain said chairs together.

12. The method of claim 11, wherein inserting a lower end of said second leg comprises inserting said lower end at an angle relative to said first leg.

13. The method of claim 12, wherein said lower end of said second leg has a stop member configured to limit retraction of said second leg from said lower ganging element.

14. The method of claim 13, wherein said stop member is configured to insert at least partially through said lower ganging element when said second leg is at an angle relative to said leg.

15. The method of claim 14, wherein said stop member limits retraction of said second leg from said lower ganging element when said first and second legs are generally parallel to one another.

16. The method of claim 15, wherein said stop member comprises a tab that extends rally rearwardly from a foot of said second leg.

17. The method of claim 11, wherein said upper ganging element receives a portion of other of said first leg and said second leg within a channel defined partially along a side of one of said first leg and said second leg.

18. The method of claim 11 including separating one chair from the other chair by pivoting said second leg forwardly to disengage said upper ganging element from said other of said first leg and said second leg and removing said second leg from said lower ganging element while said second leg is pivoted forwardly relative to said first leg.

19. The method of claim 11, wherein said upper ganging element is positioned partially along said first leg and spaced from said lower ganging element, said upper ganging element receiving a corresponding portion of said second leg when said second leg is pivoted toward alignment with said first leg.

20. The method of claim 11, wherein said chairs comprise folding chairs, said method including unfolding said chairs from a folded configuration to an unfolded configuration.

* * * * *

UNITED STATES PATENT AND TRADEMARK OFFICE

CERTIFICATE OF CORRECTION

PATENT NO. : 7,111,902 B1
APPLICATION NO. : 11/140693
DATED : September 26, 2006
INVENTOR(S) : John P. Conner It is certified that error appears in the above-identified patent and that said Letters Patent is hereby corrected as shown below:

Column 8
Claim 11, Line 2, “comprising;” should be --comprising:--
Claim 11, Line 9, “element,” should be --element;--
Claim 14, Line 27, insert --first-- between “said” and “leg”
Claim 16, Line 33, “rally” should be --generally--
Claim 17, Line 36, insert --said-- before “other”
Claim 17, Line 38, insert --said-- before “one”

Signed and Sealed this

Tenth Day of February, 2009

JOHN DOLL
*Acting Director of the United States Patent and Trademark Office*